US007067951B2

(12) United States Patent
Otani et al.

(10) Patent No.: US 7,067,951 B2
(45) Date of Patent: Jun. 27, 2006

(54) COPPER-GRAPHITE BRUSH

(75) Inventors: Takayoshi Otani, Mie (JP); Masakiyo Shimada, Mie (JP); Hirotada Kanagawa, Mie (JP); Yukinobu Isoda, Mie (JP); Kyoji Inukai, Toyota (JP); Youichi Murakami, Aichi (JP); Yasuyuki Wakahara, Kariya (JP); Masami Niimi, Handa (JP); Ryoichi Honbo, Kariya (JP)

(73) Assignees: Tris Inc., Mie (JP); Denso Corporation, Aichi (JP)

( * ) Notice: Subject to any disclaimer, the term of this patent is extended or adjusted under 35 U.S.C. 154(b) by 0 days.

(21) Appl. No.: 10/351,762

(22) Filed: Jan. 27, 2003

(65) Prior Publication Data

US 2003/0141777 A1 Jul. 31, 2003

(30) Foreign Application Priority Data

Jan. 30, 2002 (JP) ..... 2002-021065

(51) Int. Cl.
*H01R 39/18* (2006.01)

(52) U.S. Cl. ..... 310/248; 310/263; 310/228

(58) Field of Classification Search ..... 310/248, 310/263, 228, 251, 253, 252, 249; 75/231, 75/242

See application file for complete search history.

(56) References Cited

U.S. PATENT DOCUMENTS

| | | | | |
|---|---|---|---|---|
| 3,601,645 | A * | 8/1971 | Whitehead | 310/249 |
| 4,241,271 | A * | 12/1980 | Johnson | 310/219 |
| 5,270,504 | A | 12/1993 | Grohs et al. | |
| 5,441,683 | A * | 8/1995 | Kammerer et al. | 264/105 |
| 6,700,292 | B1 * | 3/2004 | Otanani | 310/248 |

FOREIGN PATENT DOCUMENTS

| | | |
|---|---|---|
| JP | 53-147609 A | 12/1978 |
| JP | 57-7872 | 1/1982 |

OTHER PUBLICATIONS

Watanabe, Yoshitada, "Sliding Contact Characteristics Between Self-Lubricating Composite Materials and Copper", *IEEE Transactions on Components, Hybrids, and Manufacturing Technology,* IEEE Inc., New York, vol. 16, No. 4, Jun. 1993, pp. 442-448.

European Search Report dated May 26, 2004.

* cited by examiner

*Primary Examiner*—Darren Schuberg
*Assistant Examiner*—Iraj A. Mohandesi
(74) *Attorney, Agent, or Firm*—The Webb Law Firm

(57) ABSTRACT

A copper-zinc alloy powder of which zinc content is from 10 to 50 wt % and of which mean particle diameter is from 15 μm or under is added to a Pb-less brush body comprising graphite, copper and a metal sulfide solid lubricant of a copper-graphite brush.

6 Claims, 3 Drawing Sheets

COPPER-GRAPHITE BRUSH

FIELD OF THE INVENTION

The present invention relates to copper-graphite brushes, containing a metal sulfide solid lubricant, which are used in electrical motors for automobiles, etc., and in particular, Pb-less copper-graphite brushes.

PRIOR ART

Copper-graphite brushes have been used as brushes for low-voltage operation, such as brushes for electrical motors in automobiles. Copper-graphite brushes are produced by mixing graphite and copper, molding and sintering the mixture. As they are operated at low voltage, their resistivities are lowered by adding copper powder of which resistance is lower than that of graphite. A metal sulfide solid lubricant, such as molybdenum disulfide or tungsten disulfide, and Pb are added to copper-graphite brushes for heavy loads in most of the cases.

In recent years, Pb has been attracting greater attention as one of materials damaging to the environment, and there is a growing demand for Pb-less brushes. Of course, brushes containing no Pb have been available up to the present and they have been used in some motors other than starting motors. Even some brushes for starting motors can be used by simply eliminating Pb from them, provided that they are used under normal service environments. To improve the lubricating properties without Pb, Japanese Patent Opening Hei 5-226048 (U.S. Pat. No. 5,270,504) proposes that a metal having a melting point lower than that of copper, such as tin or zinc, is mixed in such a way that the metal is confined in graphite, and copper and the metal do not form an alloy.

The present inventors, however, found that in copper-graphite brushes wherein a metal sulfide solid lubricant is added to copper and graphite, the elimination of Pb results in an increase in the brush resistivity or the lead connection resistance under high temperature or high humidity. The above-mentioned Japanese Patent Opening Hei 5-226048 (U.S. Pat. No. 5,270,504) does not disclose any increase in the brush resistivity or the lead connection resistance under high temperature or high humidity.

SUMMARY OF THE INVENTION

The primary object of the invention is to control the increase in the outer terminal connection resistance of a Pb-less copper-graphite brush containing a metal sulfide solid lubricant under high temperature and high humidity.

A secondary object of the invention is to provide a specific solution for the above-mentioned object.

Another secondary object of the invention is to control the increase in the resistivity of the brush body, in addition to the control of the increase in the outer terminal connection resistance.

In the present invention, the copper-graphite brush comprising a copper-graphite brush body to which a metal sulfide solid lubricant is added and an outer terminal being connected to the brush body is characterized in that a copper-zinc alloy is added to the brush body or the connection between the brush body and the outer terminal.

Preferably, a Zn content of the Cu—Zn alloy is from 10 to 50 wt %.

Preferably, the Cu—Zn alloy is added in the form of particles of which mean diameter is 15 μm or under, more preferably, of which mean diameter is from 0.1 to 15 μm, and most preferably, of which mean diameter is from 1 to 15 μm. The measurement of the mean particle diameter is made with, for example, a laser particle size distribution analyzer. The Cu—Zn alloy may be added to the surface of the connection part of the outer terminal which is to be connected to the brush body by, for example, brass plating. In this case, as the alloy is not added in the form of particles, its diameter size cannot be defined.

Preferably, the Cu—Zn alloy is added to the brush body at a rate of 1 to 10 wt %.

The metal sulfide solid lubricant is, for example, molybdenum disulfide or tungsten disulfide. Its amount of addition is, for example, from 1 to 5 wt % for the brush body. As molybdenum disulfide and tungsten disulfide have almost the same characteristics, the use of molybdenum disulfide in embodiments may be substituted with tungsten disulfide or the like. The outer terminal may be, for example, a lead molded in the brush body. The lead may be, for example, non-electroplated copper wire in forms of stranded wire, braided wire, etc. In the present invention, indications such as addition of a Cu—Zn alloy, addition of a metal sulfide solid lubricant and Pb-less do not exclude any presence of, as an impurity, a Cu—Zn alloy, Zn, a metal sulfide solid lubricant or Pb.

As a result of experiments conducted by the inventors, it was found that when copper-graphite brushes which substantially did not contain Pb and to which a metal sulfide solid lubricant was added were exposed to high temperature or high humidity, increases in their outer terminal connection resistances and brush body resistances were greater than those of brushes containing Pb. The increases in the outer terminal connection resistance and the brush body resistance are attributed to the influences of the metal sulfide solid lubricant. When no metal sulfide solid lubricant was added to the copper-graphite brushes, their outer terminal connection resistances and brush body resistances substantially did not increase under high temperature or high humidity. This is related to the presence or absence of Pb. When Pb was added, the outer terminal connection resistances and the brush body resistances hardly increased under high temperature or high humidity. In the case of Pb-less brushes, in correspondence with the increases in their outer terminal connection resistances and brush body resistances, the copper powder in the brush body and the outer terminal such as a lead embedded in the brush body showed a greater tendency to be oxidized under high temperature or high humidity.

The need of addition of a metal sulfide solid lubricant such as molybdenum disulfide or tungsten disulfide is determined by the intent of the designer of the brush, but the addition of a metal sulfide solid lubricant is indispensable to a brush which is demanded to have a long service life. Without a metal sulfide solid lubricant, an excessive wear may be generated. In particular, this phenomenon is conspicuous in conventional starter brushes to which Pb is added. When Pb and the metal sulfide sold lubricant are eliminated simultaneously, the service life of the brush will be reduced significantly. Hence in many cases, the metal sulfide solid lubricant cannot be eliminated from Pb-less brushes.

The present inventors estimated the mechanism by which the metal sulfide solid lubricant oxidizes the copper powder and the outer terminal such as a lead under high temperature or high humidity as follows: At the time of firing the brushes (sintering of the brush bodies), sulfur is liberated from the metal sulfide solid lubricant added to the brushes and absorbs on the surfaces of copper to produce copper sulfide. If moisture acts on copper sulfide under high humidity, strongly acidic copper sulfate will be produced to corrode severely the copper powder and the lead. Although the behavior of copper sulfide under high temperature is not certain in some aspects, it is estimated that copper sulfide is oxidized to increase the electrical resistance.

To cope with this, the present inventors have found that addition of an alloy of copper and zinc (brass) can control increases in the resistances under high temperature and high humidity. The addition of brass to the brush body can prevent both the increase in the high resistivity of the brush body and the increase in the outer terminal connection resistance under high temperature or high humidity. The addition of brass to the connection part for the outer terminal can prevent the increase in the outer terminal connection resistance under high temperature or high humidity. Addition of simple zinc can prevent increases in the resistances under high humidity, but it cannot sufficiently prevent increases in the resistances under high temperature.

The content of zinc in brass is preferably from 10 to 50% in weight percent. If the zinc content is less than 10%, its effect will be small, and if the zinc content exceeds 50%, the brass particles will be hard and brittle and may have bad influences on the sliding characteristics of the brush body. When the zinc content in brass is in the range of 10 to 50%, the addition of brass can effectively prevent increases in the resistances under high temperature or high humidity.

The smaller is the mean particle diameter of brass, the greater is the effect of the brass addition in preventing increases in the resistances. For example, the addition of brass particles of 15 μm in mean particle diameter has much greater effects than brass particles of 50 μm.

Brass is added to the brush body by, for example, 1 to 10 wt %, and preferably, it is added to the entire brush body almost evenly. When the addition of brass is less than 1 wt %, the effect is small. As the conductivity of brass is lower than that of copper, if the addition of brass exceeds 10 wt %, the resistivity of the brush body will increase. When the brass addition is in the range of 1 to 10 wt %, it can effectively control the increase in the outer terminal connection resistance and the increase in the resistivity of the brush body under high temperature or high humidity.

EMBODIMENTS

Figure 1:
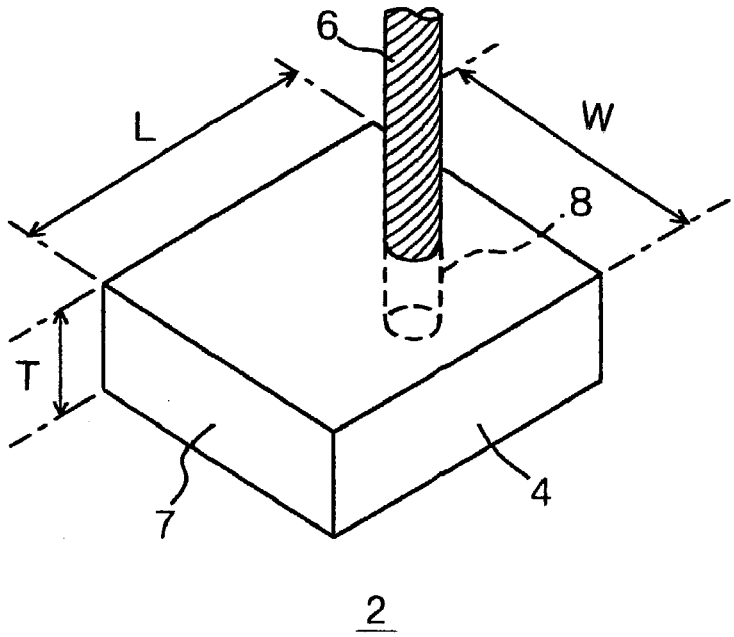
FIG. 1 is a perspective view of a copper-graphite brush of an embodiment.

FIG. 1 shows the copper-graphite brush 2 of an embodiment, and in the following, the copper-graphite brush is simply referred to as the brush. The brush is used, for example, as a brush of electrical motors in automobiles, such as a brush of a starting motor. 4 denotes a brush body which contains graphite, copper, a metal sulfide solid lubricant and brass particles. In the embodiment, a bialloy of copper and zinc is used, however, a third component, such as tin, may be contained in the brass, provided its content is no more than 10 wt %. 6 denotes a lead, and here it is a stranded wire or a braided wire of nonelectroplated copper wires, but it may be a copper lead of which wire is electroplated with, for example, nickel. 7 denotes a face which contacts with a commutator of a rotational electric armature. 8 denotes a lead side portion in which the lead is embedded. The brush 2 is produced by molding the compounded powders in a mold with the top end of the lead 6 being set therein, and sintering the molding in a reducing atmosphere.

The metal sulfide solid lubricant may be, for example, molybdenum disulfide or tungsten disulfide, and its addition for the brush body 4 is preferably from 1 to 5 wt %. If its addition is less than 1 wt %, its lubricating effect will be deficient, and if its addition exceeds 5 wt %, the resistivity of the brush will increase. Pb is not added to the brush body 4. To prevent the resistivity of the brush body or the lead connection resistance from increasing due to the metal sulfide solid lubricant under high temperature or high humidity, brass particles are preferably added to the brush body material by 1 to 10 wt %, and the mean particle diameter of the brass particles is preferably 15 μm or under, more preferably from 0.1 to 15 μm, and most preferably from 1 to 15 μm.

The zinc content in the brass is preferably from 10 to 50 wt %, and if its content is less than 10 wt %, its effect is deficient, and if its content exceeds 50 wt %, the brass will become harder and more brittle and many have bad influences on the sliding characteristics of the brush. As the electric conductivity of brass is lower than that of pure copper, it is not desirable to add brass by more than 10 wt %, and if its addition is 1 wt % or under, its effects will be small. Brass particles of which mean particle diameter is 15 μm or under can be obtained by the atomization process. In this specification, Pb-less means that the Pb content is not more than the impurity level (the maximum is 0.2 wt %), and the impurity level of zinc is, for example, 0.05 wt % or under.

Figure 2:
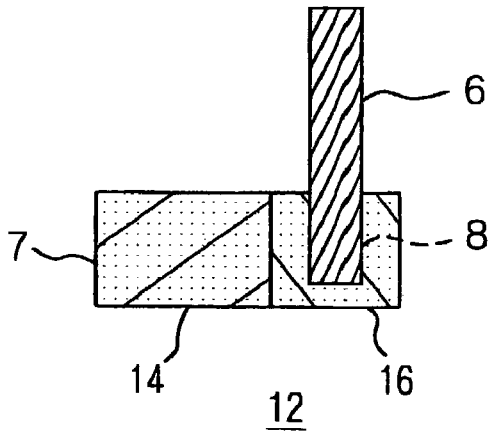
FIG. 2 is a sectional view of a copper-graphite brush of a modification.

FIG. 2 shows the brush 12 of a modification. In this brush 12, brass particles are added only to brush body material in the neighborhood of the embedment part 8 of the lead 6, and no brass particles are added to the commutator-contact face 7 side of the brush body. In this brush 12, the brush body resistivity of the commutator-contact face side is not prevented from increasing, but the lead connection resistance can be prevented from increasing under high temperature or high humidity. In FIG. 2, 14 denotes a commutator side member comprising copper, graphite and a metal sulfide solid lubricant. 16 denotes a lead embedment member comprising copper, graphite, brass and the metal sulfide solid lubricant. Even if no metal sulfide solid lubricant is added to the lead embedment member 16, addition of brass is needed because there will be influences of sulfate ion coming from the metal sulfide solid lubricant in the commutator side member 14 or influences of the metal sulfide solid lubricant of an impurity level in the lead embedment member 16.

Brass is added at least to a neighborhood of the embedment part 8 of the lead 6. For example, a copper-graphite powder to which brass particles have been added may be made to adhere to the top end of a lead, and the lead may be set in a brush material to which no brass has been added and the brush material with the lead may be molded. In such a case, as the area to which brass has been added will become obscure, the brass concentration in the brush material in the neighborhood of the interface between the lead 6 and the brush body is defined as the brass concentration in the lead embedment part. The description concerning the brush 2 of FIG. 1 also applies to the brush 12 of FIG. 2 unless specified otherwise, and preferably, the brass concentration of the lead embedment part 16 is from 1 to 10 wt %, the zinc content in the brass is from 10 to 50 wt %, and the mean particle diameter of the brass is 15 μm or under, more preferably from 0.1 to 15 μm, and most preferably from 1 to 15 μm.

Figure 3:
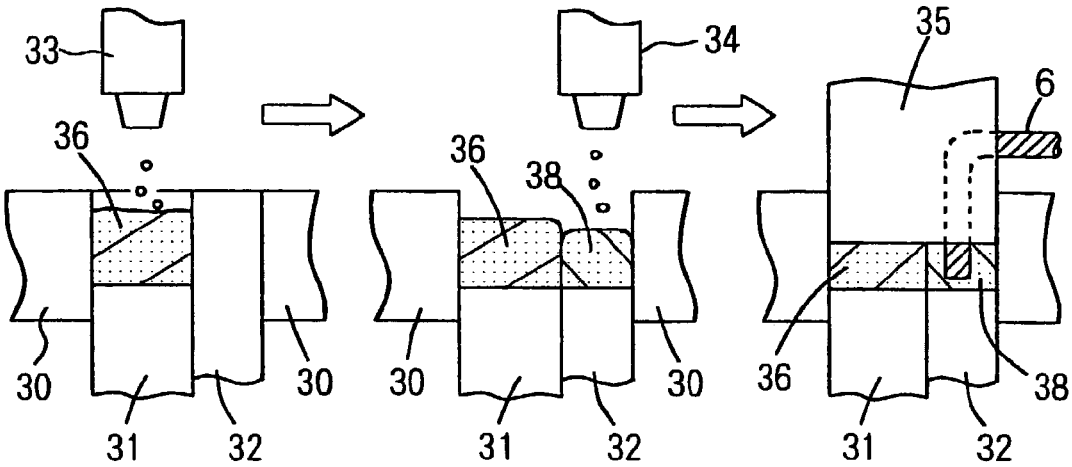
FIG. 3 schematically shows the production process of the copper-graphite brush of the modification.

The brush 12 of FIG. 2 is produced, for example, as shown in FIG. 3. A fixed die 30 is provided with, for example, a pair of lower movable dies 31, 32. A portion corresponding to the lead embedment member is first blocked by the lower movable die 32. Then a brass-less powder material 36 is fed from a first hopper 33. Next, the lower movable die 32 is retracted, and a powder material 38 to which zinc particles have been added is fed from a second hopper 34. Then an upper movable die 35 with the lead wire 6 being drawn out of the top end thereof is lowered so as to embed the top end of the lead wire 6, then integral molding is effected. In this way, both the commutator side member and the lead embedment member are molded integrally, and at the same time the top end of the lead wire is molded. When the molding is sintered in a reducing atmosphere or the like, the brush 2 is obtained.

Figure 4:
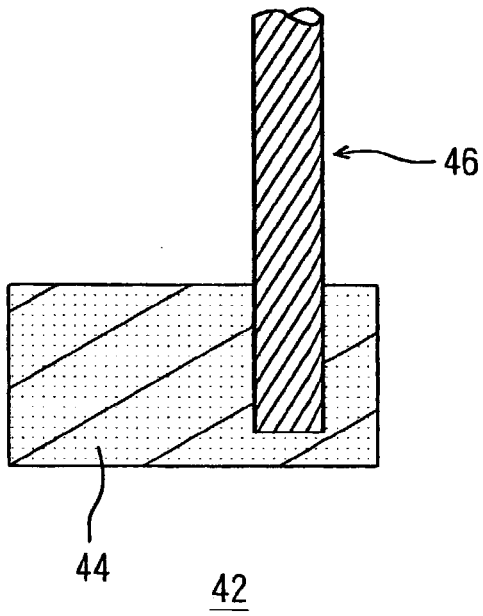
FIG. 4 is a sectional view of a copper-graphite brush of a second modification.
Figure 5:
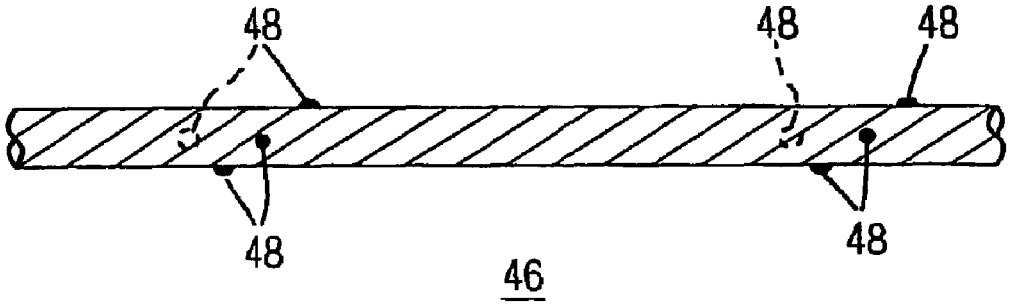
FIG. 5 schematically shows a lead which is used in the second modification.

FIG. 4 and FIG. 5 show a second modification. 42 denotes a new copper-graphite brush, and no brass is added to the powder material for its brush body 44. A lead wire 46 being a stranded or braided wire of copper is spotted with a paste, in which brass particles of 15 μm or under in mean particle diameter are used, by a dispenser, a head of an ink jet printer, etc. The spots of the paste are used as brass sources 48. The brass sources 48 are provided on a portion of the lead wire 46, the portion being to be embedded in the brush body 44. For example, the spots are located on the lead wire 46 in the direction of its length at a plurality of points, for example, 3 or 4 points, on its circumference.

When the lead wire 46 having the brass sources 48 is used to mold and sinter the brush 42 in the manner similar to that of the conventional brush, the lead connection resistance can be prevented from increasing. Instead of this, the copper lead wire's portion to be embedded in the brush body may be electroplated with a brass alloy. The description of the brush 2 of FIG. 1 also applies to the brush 42 of FIG. 4 unless specified otherwise.

EXAMPLES

Some examples are shown below. The configuration of each brush is the one shown in FIG. 1, and the brush body 4 has the width W and the length L of about 12 mm, respectively, and the width T of 4.8 mm. The lead wire 6 is a stranded wire of nonelectroplated copper wires, and the diameter is 3.5 mm, and the depth of its embedded part is 4.5 mm.

Example 1

30 parts by weight of resol type phenol resin and 10 parts by weight of methanol were mixed with 100 parts by weight of natural flaky graphite. They were homogeneously mixed up by a mixer, and methanol was dried out of the mixture by a drier. The residue was crushed by an impact crusher and sieved with a sieve of 40 mesh pass (a 405 μm pass sieve) to obtain a resin finished graphite powder.

54.0 parts by weight of electrolytic copper powder having a mean particle diameter of 35 μm, 3.0 parts by weight of molybdenum disulfide powder, and 3.0 parts by weight of atomized Cu—Zn alloy powder of which mass ratio of zinc to copper was 20:80 and mean particle diameter was 10 μm were added to 40 parts by weight of the resin finished graphite powder. They were homogeneously mixed by a V type mixer to obtain a compounded powder. The compounded powder was fed from a hopper into dies, and the top end of the lead wire 6 was embedded in the compounded powder in the dies, then the compounded powder was molded under a pressure of $4\times10^8$ Pa ($4\times9800$ N/cm$^2$). The molding was sintered in a reducing atmosphere in an electric furnace at 700° C. to obtain a brush of example 1. The atomized Cu—Zn alloy powder is fine particles of a Cu—Zn alloy, which are produced by subjecting the molten alloy to a high-speed gas stream. This process affords fine brass spherical particles down to mean particle diameter of about 1 μm. In place of this, if the wet reduction process is used, Cu—Zn alloy particles down to mean particle diameter of about 0.1 μm can be obtained.

In the following, alloy compositions are expressed by mass weight ratio. With some weight loss of the finished graphite powder in the sintering process, the composition after sintering changes from that at the time of compounding. The measurement of the mean particle diameter by means of a laser particle size distribution analyzer is done by dispersing brass particles in a liquid and determining their mean particle size from the measurement of the light scattered by them. In the embodiment, the laser particle size distribution analyzer used was COULTER LS 100 made of Coulter Electronics Inc. (COULTER LS100 is a trade name).

Example 2

53 parts by weight of the above mentioned electrolytic copper powder, 3.0 parts by weight of molybdenum disulfide, and 9 parts by weight of atomized brass powder of which Zn—Cu ratio was 20 to 80 and mean particle diameter was 10 μm were added to 35 parts by weight of the above mentioned resin finished graphite powder. They were treated in the same manner as example 1 to obtain a brush of example 2.

Example 3

54 parts by weight of the above mentioned electrolytic copper powder, 3 parts by weight of molybdenum disulfide, and 3 parts by weight of atomized brass powder of which Zn—Cu ratio was 40 to 60 and mean particle diameter was 10 μm were added to 40 parts by weight of the above mentioned resin finished graphite powder. They were treated in the same manner as example 1 to obtain a brush of example 3.

Example 4

56 parts by weight of the above mentioned electrolytic copper powder, 3 parts by weight of molybdenum disulfide, and 1 part by weight of atomized brass powder of which Zn—Cu ratio was 40 to 60 and mean particle diameter was 10 μm were added to 40 parts by weight of the above mentioned resin finished graphite powder. They were treated in the same manner as example 1 to obtain a brush of example 4.

Example 5

53 parts by weight of the above mentioned electrolytic copper powder, 3 parts by weight of molybdenum disulfide, and 9 parts by weight of atomized brass powder of which Zn—Cu ratio was 40 to 60 and mean particle diameter was 10 μm were added to 35 parts by weight of the above mentioned resin finished graphite powder. They were treated in the same manner as example 1 to obtain a brush of example 5.

Example 6

54 parts by weight of the above mentioned electrolytic copper powder, 3 parts by weight of molybdenum disulfide, and 3 parts by weight of atomized brass powder of which Zn—Cu ratio was 20 to 80 and mean particle diameter was 5 μm were added to 40 parts by weight of the above mentioned resin finished graphite powder. They were treated in the same manner as example 1 to obtain a brush of example 6.

Example 7

56.5 parts by weight of the above mentioned electrolytic copper powder, 3 parts by weight of molybdenum disulfide, and 0.5 part by weight of atomized brass powder of which Zn—Cu ratio was 40 to 60 and mean particle diameter was 10 μm were added to 40 parts by weight of the above mentioned resin finished graphite powder. They were treated in the same manner as example 1 to obtain a brush of example 7.

Example 8

54 parts by weight of the above mentioned electrolytic copper powder, 3 parts by weight of molybdenum disulfide, and 3 parts by weight of crushed brass powder of which Zn—Cu ratio was 30 to 70 and mean particle diameter was 50 μm were added to 40 parts by weight of the above mentioned resin finished graphite powder. They were treated in the same manner as example 1 to obtain a brush of example 8.

Example 9

54 parts by weight of the above mentioned electrolytic copper powder, 3 parts by weight of molybdenum disulfide, and 3 parts by weight of atomized zinc powder of which mean particle diameter was 30 μm were added to 40 parts by weight of the above mentioned resin finished graphite powder. They were treated in the same manner as example 1 to obtain a brush of example 9.

Example 10

57 parts by weight of the above mentioned electrolytic copper powder and 3 parts by weight of molybdenum disulfide were added to 40 parts by weight of the above mentioned resin finished graphite powder. They were treated in the same manner as example 1 to obtain a brush of example 10.

Example 11

55 parts by weight of the above mentioned electrolytic copper powder, 3 parts by weight of molybdenum disulfide, and 2 parts by weight of Pb were added to 40 parts by weight of the above mentioned resin finished graphite powder. They were treated in the same manner as example 1 to obtain a brush of example 11.

As for the compositions of the brushes after sintering, as the resol type phenol resin is partially decomposited and lost in weight during sintering, the content of the Cu—Zn alloy or the like increases by about 3% in comparison with its compounded concentration. Table 1 shows the brass contents, brass mean particle diameters, Cu—Zn ratios in the alloys of the brushes or the like of examples 1 through 11. 0% in content in Table 1 indicates that the content is of the impurity level.

TABLE 1

Sample Compositions

| Sample | Pb content | Brass content | Mean particle diameter | Zn content in brass |
|---|---|---|---|---|
| Example 1 | 0% | 3.1% | 10 μm | 20% |
| Example 2 | 0% | 9.3% | 10 μm | 20% |
| Example 3 | 0% | 3.1% | 10 μm | 40% |
| Example 4 | 0% | 1.03% | 10 μm | 40% |
| Example 5 | 0% | 9.3% | 10 μm | 40% |
| Example 6 | 0% | 3.1% | 5 μm | 40% |
| Example 7 | 0% | 0.5% | 10 μm | 40% |
| Example 8 | 0% | 3.1% | 50 μm | 30% |
| Example 9 | 0% | Pure zinc powder of 30 μm in measure particle diameter by 3.1% is contained. | | |
| Example 10 | 0% | 0% | | |
| Example 11 | 2.0% | 0% | | |

*All the contents of the lubricant (molybdenum disulfide) are 3.1 wt %.

*The contents are in wt % in relation to the brush body material.

*Example 9 is a comparative example for comparing Cu—Zn alloy and simple zinc.

*Examples 1 through 6 are the best modes, and examples 7 and 8 show extreme forms of addition of Cu—Zn alloys.

The brushes of examples 1 through 11 were put in an electric oven at 180° C. for 400 hours and forced to be oxidized, and their lead connection resistances and brush body resistivities before and after the exposure were measured. Furthermore, the brushes of examples 1 through 11 were put in a constant-temperature & constant-humidity vessel of 40° C. and relative humidity of 95% to expose them to the high humidity and force copper therein to be oxidized, and their lead connection resistances and brush body resistivities were measured after 400 hours of exposure. The number of measurements for each sample is ten, and the arithmetic mean was obtained. The measurements of the lead connection resistances were made in accordance with "Method of testing the lead connection resistance of brushes for electrical machines" described in Japan Carbon Association Standards, JCAS-12-1986. The resistivities of the brush bodies were measured by the 4-terminal method in a direction perpendicular to the pressing direction at the time of brush molding.

Changes in the lead connection resistances resulting from the exposure to 180° C. are shown in Table 2, and changes in the lead connection resistances due to the 40° C. & 95% exposure test are shown in Table 3. Changes in the brush body resistivities before and after the 180° C. exposure test are shown in Table 4, and changes in the brush body resistivities resulting from the 40° C. & 95% exposure test are shown in Table 5.

TABLE 2

Changes in lead connection resistances resulting from exposure to 180° C.

| Sample | Lead connection resistance (unit: mV/10A) Initial value | After 400 hours |
|---|---|---|
| Example 1 | 1.2 | 2.6 |
| Example 2 | 1.3 | 2.4 |
| Example 3 | 1.2 | 2.5 |
| Example 4 | 1.2 | 3.0 |
| Example 5 | 1.3 | 2.4 |
| Example 6 | 1.2 | 2.5 |
| Example 7 | 1.2 | 3.6 |
| Example 8 | 1.4 | 3.2 |
| Example 9 | 1.2 | 4.3 |
| Example 10 | 1.2 | 5.7 |
| Example 11 | 1.2 | 1.8 |

*Examples 9 through 11 are comparative examples.

TABLE 3

Changes in lead connection resistances resulting from exposure to 40° C. and relative humidity of 95%

| Sample | Lead connection resistance (unit: mV/10A) Initial value | After 400 hours |
|---|---|---|
| Example 1 | 1.2 | 1.8 |
| Example 2 | 1.3 | 1.7 |
| Example 3 | 1.2 | 1.8 |
| Example 4 | 1.2 | 4.5 |
| Example 5 | 1.3 | 1.7 |
| Example 6 | 1.2 | 1.7 |
| Example 7 | 1.2 | 9.8 |
| Example 8 | 1.4 | 10.4 |
| Example 9 | 1.2 | 1.9 |
| Example 10 | 1.2 | 34.7 |
| Example 11 | 1.2 | 1.5 |

*Examples 9 through 11 are comparative examples.

TABLE 4

Changes in resistivities before and after the exposure to 180° C.

| Sample | Brush body resistivity (unit: μΩ · cm) Initial value | After 400 hours |
|---|---|---|
| Example 1 | 22.1 | 42.6 |
| Example 2 | 24.2 | 43.2 |
| Example 3 | 22.2 | 44.3 |
| Example 4 | 21.9 | 56.4 |
| Example 5 | 24.4 | 43.0 |
| Example 6 | 22.2 | 43.4 |
| Example 7 | 21.8 | 72.9 |
| Example 8 | 24.2 | 73.6 |
| Example 9 | 23.2 | 82.4 |
| Example 10 | 21.2 | 96.3 |
| Example 11 | 22.2 | 31.3 |

*Examples 9 through 11 are comparative examples.

TABLE 5

Changes in resistivities before and after the exposure to 40° C. and relative humidity of 95%

| Sample | Brush body resistivity (unit: μΩ · cm) Initial value | After 400 hours |
|---|---|---|
| Example 1 | 22.2 | 24.6 |
| Example 2 | 24.1 | 26.2 |
| Example 3 | 22.4 | 24.1 |
| Example 4 | 22.1 | 43.2 |
| Example 5 | 24.2 | 26.4 |
| Example 6 | 22.1 | 24.1 |
| Example 7 | 22.0 | 76.0 |
| Example 8 | 24.6 | 103 |
| Example 9 | 23.3 | 25.6 |
| Example 10 | 21.0 | 211 |
| Example 11 | 21.9 | 23.6 |

*Examples 9 through 11 are comparative examples.

In the leaded brush of example 11, the lead connection resistance and the brush body resistivity do not increase under high temperature or high humidity, whereas in the simple Pb-less brush of example 10, both the lead connection resistance and the brush body resistivity increase markedly under high temperature or high humidity. The temperature of 40° C. and humidity of 95% are the conditions for an accelerated test. However, even at room temperature, if these brushes are exposed to high humidity for a long period, the brushes are oxidized and their lead connection resistances and resistivities increase similarly. In contrast to them, addition of brass powder of 15 μm or smaller in mean particle diameter by 1 to 10 wt % in examples 1 through 6, resulted in brushes of which resistances do not change much under high temperature or high humidity. In example 7, when the brass addition is less than 1%, its effect was small, and in example 8, when crushed brass powder (mean particle diameter is 50 μm) in place of the atomized brass powder was used, the effect was small. When simple zinc which is not alloyed with copper was used (example 9), the lead connection resistance and the brush body resistivity increased under high temperature.

Although not demonstrated by examples, addition of brass powder only to the neighborhood of the lead wire embedment part, or supply of brass from the lead wire can prevent the lead connection resistance from increasing under high temperature or high humidity. Exactly the same results can be obtained when molybdenum disulfide is substituted by tungsten disulfide. The lower limit of the mean particle diameter of brass powder is, for example, 0.1 μm, and preferably, 1 μm.

The invention claimed is:

1. A copper-graphite brush comprising a brush body comprising copper, graphite and a metal sulfide solid lubricant and an outer terminal connected with said brush body characterized in that said brush body includes substantially no lead and a copper-zinc alloy is added to at least one member of said brush body and a connection part between said brush body and said outer terminal; and said cooper-zinc alloy is in the form of particles having a mean particle diameter of 15 μm or under.

2. A copper-graphite brush of claim 1 characterized in that the zinc content in said copper-zinc alloy is from 10 to 50 wt %.

3. A copper-graphite brush of claim 1 characterized in that said copper-zinc alloy is added to the brush by 1 to 10 wt %.

4. A copper-graphite brush comprising a brush body to which a metal sulfide solid lubricant is added and an outer terminal connected with said brush body characterized in that a copper-zinc alloy is added to at least one member of said brush body and a connection part between said brush body and said outer terminal, said copper-zinc alloy being in the form of particles having a mean particle diameter of 15 μm or under.

5. A copper-graphite brush of claim 4 characterized in that the zinc content in said copper-zinc alloy is from 10 to 50 wt %.

6. A copper-graphite brush of claim 4 characterized in that said copper-zinc alloy is added to the brush by 1 to 10 wt %.

* * * * *

UNITED STATES PATENT AND TRADEMARK OFFICE

CERTIFICATE OF CORRECTION

PATENT NO. : 7,067,951 B2
APPLICATION NO. : 10/351762
DATED : June 27, 2006
INVENTOR(S) : Otani et al.

It is certified that error appears in the above-identified patent and that said Letters Patent is hereby corrected as shown below:

Column 10, lines 62-63, Claim 1,

"; and
said cooper-zinc alloy" should read

-- and
said copper-zinc alloy --

Signed and Sealed this

Twenty-first Day of November, 2006

JON W. DUDAS
*Director of the United States Patent and Trademark Office*